US005713800A

United States Patent [19]

Su

[11] Patent Number: 5,713,800

[45] Date of Patent: Feb. 3, 1998

[54] GOLF CLUB HEAD

[76] Inventor: Charles Su, No. 37-4, Ao Tzu Chiao, Tungshan Hsiang, Tainan Hsien, Taiwan

[21] Appl. No.: 760,829

[22] Filed: Dec. 5, 1996

[51] Int. Cl.[6] ..... A63B 53/04

[52] U.S. Cl. ..... 473/342; 473/349; 473/350

[58] Field of Search ..... 473/324, 342, 473/349, 350

[56] References Cited

U.S. PATENT DOCUMENTS

| | | | |
|---|---|---|---|
| 4,883,275 | 11/1989 | Boone | 473/342 X |
| 4,884,812 | 12/1989 | Nagasaki et al. | 473/342 |
| 5,106,094 | 4/1992 | Desbiolles et al. | 473/342 |
| 5,472,201 | 12/1995 | Aizawa et al. | 473/342 X |
| 5,509,660 | 4/1996 | Elmer | 473/342 X |
| 5,531,439 | 7/1996 | Azzarella | 473/342 X |
| 5,603,667 | 2/1997 | Ezaki et al. | 473/342 X |

*Primary Examiner*—Raleigh W. Chiu

*Attorney, Agent, or Firm*—Merchant, Gould, Smith, Edell, Welter & Schmidt, P.A.

[57] ABSTRACT

A golf club head includes a striking surface having a first side face, a second side face, and a peripheral portion. A recess is defined in the peripheral portion of the striking surface and is located adjacent to the first side face thereof. A composite body has one side face attached to the second side face of the striking surface and a peripheral portion enclosed on the peripheral portion of the striking surface. A retaining flange is formed on the peripheral portion of the composite body and is received in the recess of the striking surface.

6 Claims, 3 Drawing Sheets

GOLF CLUB HEAD

FIELD OF THE INVENTION

The present invention relates to a golf club head.

BACKGROUND OF THE INVENTION

A kind of conventional golf club head is made of a Titanium alloy with possessing light weight and high strength. By such an arrangement, a plurality of counterweights are required to be mounted in the golf club head, thereby providing a stable effect thereon. However, it is necessary to precisely determine the number and the location of the counterweights in the golf club head, so easily incurring a difficulty in producing the golf club head. In addition, the golf club head is entirely made of Titanium alloy which is expensive, thereby greatly increasing the cost for manufacturing the golf club head.

The present invention has arisen to mitigate and/or obviate the disadvantage of the conventional golf club head.

SUMMARY OF THE INVENTION

In accordance with one aspect of the present invention, there is provided a golf club head comprising a striking surface having a first side face, a second side face, and a peripheral portion. A recess is defined in the peripheral portion of the striking surface and is located adjacent to the first side face of the striking surface.

A composite body has one side face attached to the second side face of the striking surface and a peripheral portion enclosed on the peripheral portion of the striking surface. A retaining flange is formed on the peripheral portion of the composite body and is received in the recess of the striking surface.

Further features of the present invention will become apparent from a careful reading of the detailed description with appropriate reference to the accompanying drawings.

DETAILED DESCRIPTION OF THE PREFERRED EMBODIMENTS

Figure 1:
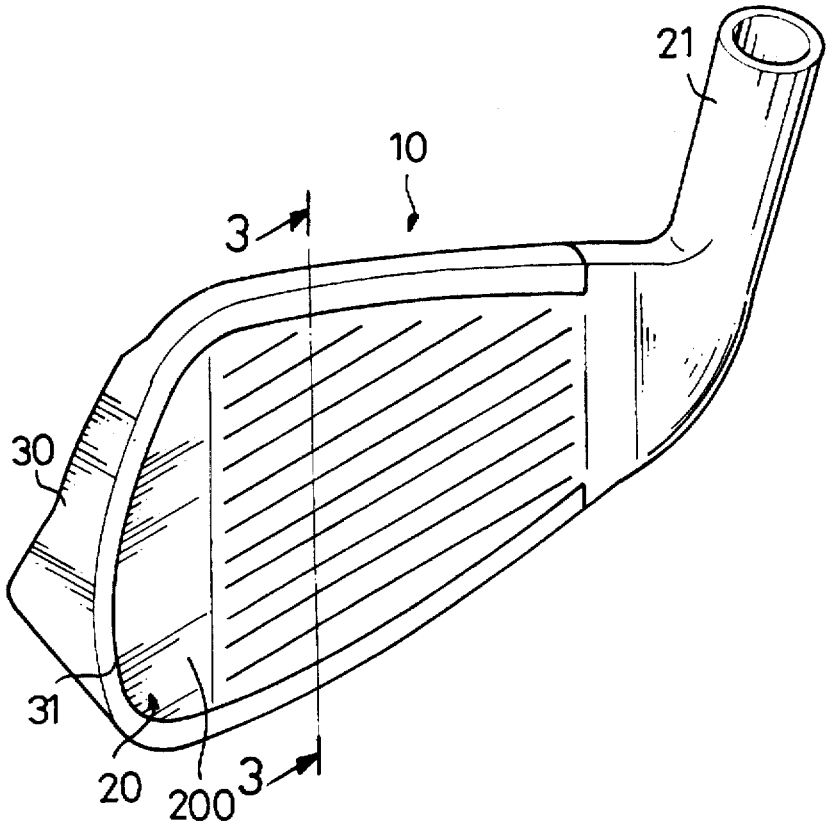
FIG. 1 is a perspective view of a golf club head in accordance with the present invention.
Figure 2:
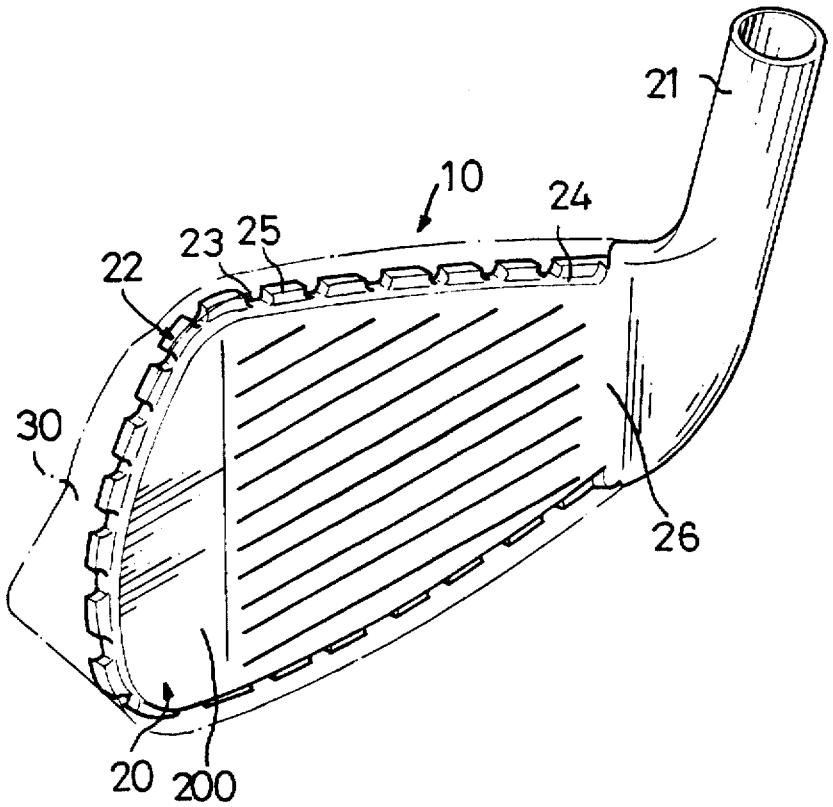
FIG. 2 is a perspective view of a striking surface of the golf club head.
Figure 3:
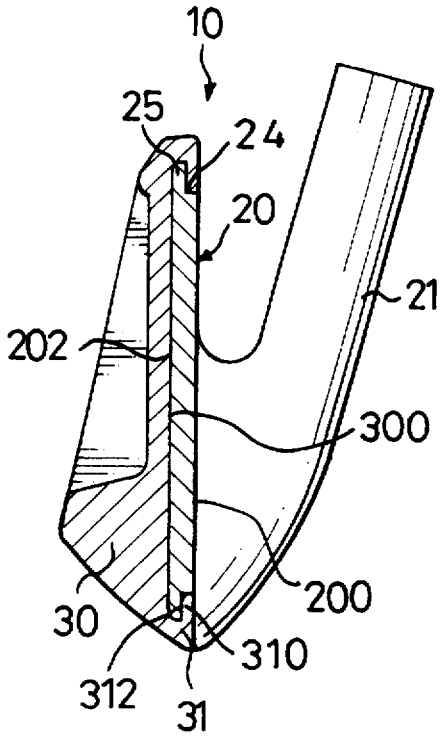
FIG. 3 is a side cross-sectional view of FIG. 2.

Referring to the drawings, a golf club head 10 in accordance with the present invention is provided for an iron-type golf club and comprises a striking surface 20 made of a Titanium alloy including a first side face 200, a second side face 202, and a peripheral portion 22. A recess 24 is defined in the peripheral portion 22 of the striking surface 20 and located adjacent to the first side face 200 of the striking surface 20. Preferably, the striking surface 20 has a heel portion 26 integrally formed with a shaft 21.

A composite body 30 made of metal has one side face 300 attached to the second side face 202 of the striking surface 20 and a peripheral portion 31 enclosed on the peripheral portion 22 of the striking surface 20 and flush with the first side face 200 of the striking surface 20 as shown in FIG. 1.

A retaining flange 310 is formed on the peripheral portion 31 of the composite body 30 and is received in the recess 24 of the striking surface 20.

The composite body 30 has a specific gravity greater than that of the striking surface 20.

Preferably, a plurality of teeth 25 protrude outwardly from the peripheral portion 22 of the striking surface 20, and a groove 312 is defined in the peripheral portion 31 of the composite body 30 for receiving the plurality of teeth 25 therein.

In addition, the plurality of teeth 25 are equally spaced from each other, and a plurality of openings 23 are each defined between any two adjacent teeth 25.

In manufacturing, the striking surface 20 formed with the plurality of teeth 25 is pre-produced and can then be pressed into a mold (not shown) through which the composite body 30 in molten phase due to a high temperature is brought to surround the peripheral portion 22 of the striking surface 20. Finally, the composite body 30 can be securely mounted on the striking surface 20 after cooling by means of an engagement between the retaining flange 310 and the teeth 25.

By such an arrangement, the composite body 30 can be adapted to serve as a counterweight of the striking surface 20, thereby providing an adjusting effect on the striking surface 20.

In addition, the composite body 30 is made of a metal such as a stainless steel, a copper alloy and the like with a price cheaper than that of the Titanium alloy, thereby greatly reducing the cost for manufacturing the golf club head 10.

It should be clear to those skilled in the art that further embodiments of the present invention may be made without departing from the spirit and scope of the present invention.

What is claimed is:

1. A golf club head comprising:

a striking surface (20) having a first side face (200), a second side face (202), and a peripheral portion (22), a recess (24) defined in the peripheral portion (22) of said striking surface (20) and located adjacent to the first side face (200) thereof; and a composite body (30) having one side face (300) attached to the second side face (202) of said striking surface (20) and a peripheral portion (31) enclosed on the peripheral portion (22) of said striking surface (20), a retaining flange (310) formed on the peripheral portion (31) of said composite body (30) and received in said recess (24) of said striking surface (20).

2. The golf club head in accordance with claim 1, wherein said striking surface (20) is made of a Titanium alloy.

3. The golf club head in accordance with claim 1, wherein a plurality of teeth (25) protrude outwardly from the peripheral portion (22) of said striking surface (20), and a groove (312) defined in the peripheral portion (31) of said composite body (30) for receiving said plurality of teeth (25) therein.

4. The golf club head in accordance with claim 3, wherein said plurality of teeth (25) are equally spaced from each other, and a plurality of openings (23) each defined between any said two adjacent teeth (25).

5. The golf club head in accordance with claim 1, wherein said composite body (30) is made of metal.

6. The golf club head in accordance with claim 5, wherein said composite body (30) has a specific gravity greater than that of said striking surface (20).

* * * * *